US010951969B2

(12) United States Patent
Sano

(10) Patent No.: US 10,951,969 B2
(45) **Date of Patent: *Mar. 16, 2021**

(54) CASE FOR MICROPHONE DEVICE

(71) Applicant: Audio-Technica Corporation, Tokyo (JP)

(72) Inventor: Yusuke Sano, Tokyo (JP)

(73) Assignee: AUDIO-TECHNICA CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/707,202

(22) Filed: Dec. 9, 2019

(65) Prior Publication Data

US 2020/0112780 A1 Apr. 9, 2020

Related U.S. Application Data

(63) Continuation of application No. 16/268,907, filed on Feb. 6, 2019, now Pat. No. 10,536,762.

(30) Foreign Application Priority Data

Feb. 8, 2018 (JP) ..... 2018-020647

(51) Int. Cl.
*H04R 1/08* (2006.01)
*H04R 1/04* (2006.01)
(Continued)

(52) U.S. Cl.
CPC ..... *H04R 1/04* (2013.01); *H04R 1/08* (2013.01); *H04R 1/083* (2013.01); *H04R 1/34* (2013.01);
(Continued)

(58) Field of Classification Search
CPC ..... H04R 1/08; H04R 1/083; H04R 1/086; H04R 1/34; H04R 1/342; H04R 1/406;
(Continued)

(56) References Cited

U.S. PATENT DOCUMENTS 3,462,553 A * 8/1969 Spranger ..... H01L 23/4006 381/334
3,778,551 A * 12/1973 Grodinsky ..... H05K 7/209 381/335
(Continued)

FOREIGN PATENT DOCUMENTS

CN 201369806 Y 12/2009
EP 0 374 902 A2 12/1989
(Continued)

OTHER PUBLICATIONS

Jin et al: "Design, Optimization and Evaluation of a Dual-Radius Spherical Microphone Array", IEEE/ACM Transactions on Audio, Speech, and Language Processing, vol. 22, No. 1, pp. 193-204, Jan. 2014.
(Continued)

*Primary Examiner* — Huyen D Le
(74) *Attorney, Agent, or Firm* — W&C IP

(57) ABSTRACT

A case for a microphone device includes; a housing part that has a circuit board therein; and a protrusion part that protrudes from a first end face of the housing part in a longitudinal direction so as to expose to the outside, the protrusion part being formed such that a diameter of the protrusion part becomes smaller from a root coupled to the first end face toward a tip.

7 Claims, 10 Drawing Sheets

(51) Int. Cl.

| | |
|---|---|
| ***H04R 1/40*** | (2006.01) |
| ***H04R 3/00*** | (2006.01) |
| ***H04R 1/34*** | (2006.01) |
| ***H04R 5/027*** | (2006.01) |

(52) U.S. Cl.
CPC ..... *H04R 1/342* (2013.01); *H04R 1/406* (2013.01); *H04R 3/005* (2013.01); *H04R 5/027* (2013.01); *H04R 2201/401* (2013.01); *H04R 2201/403* (2013.01); *H04R 2420/07* (2013.01)

(58) Field of Classification Search
CPC ..... H04R 9/022; H04R 2201/405; H04R 2410/07; H04R 1/04; H04R 2420/07
USPC ..... 381/160, 335, 111, 355, 360, 361, 362, 381/363, 397

See application file for complete search history.

(56) References Cited

U.S. PATENT DOCUMENTS

| | | | | |
|---|---|---|---|---|
| 5,097,513 | A * | 3/1992 | Jordan | H04R 3/00 381/111 |
| 6,285,772 | B1 * | 9/2001 | Tate | H04R 1/406 379/433.03 |
| 8,520,880 | B2 * | 8/2013 | Akino | H04R 1/086 381/369 |
| 9,084,057 | B2 * | 7/2015 | Turqueti | H04R 1/326 |
| 10,536,761 | B2 * | 1/2020 | Mittleman | H04M 1/035 |
| 2008/0232192 | A1 | 9/2008 | Williams | |
| 2018/0288525 | A1 * | 10/2018 | Katz | H04R 9/022 |

FOREIGN PATENT DOCUMENTS

| | | | |
|---|---|---|---|
| EP | 2 747 449 | A1 | 6/2014 |
| EP | 3 012 651 | A2 | 4/2016 |
| JP | 2016-163091 | A | 9/2016 |

OTHER PUBLICATIONS

European Patent Office, EP19153947, extended search report, dated Jun. 19, 2019.

* cited by examiner

CASE FOR MICROPHONE DEVICE

CROSS-REFERENCE TO RELATED APPLICATIONS

The present application is a continuation application of U.S. patent application Ser. No. 16/268,907, filed on Feb. 6, 2019 which claims the benefit of Japanese Priority Patent Application No. 2018-020647, filed on Feb. 8, 2018. The contents of all-listed applications are incorporated herein by reference in their entirety.

BACKGROUND

The present invention relates to a microphone device and a case for the microphone device that can collect sound from all 360-degree directions.

In recent years, in order to collect sound with a sense of presence, a microphone device that has a microphone capsule having a plurality of sound collecting parts arranged at predetermined intervals on a surface of a sphere has been proposed. The proposed microphone device has a case for the microphone device (hereinafter simply referred as a case) provided with a circuit board that performs signal processing. The microphone capsule is supported apart from the case.

In the above-mentioned microphone device, however, there is a risk that a sound wave reflected at the case which is on a back side of the microphone capsule would enter the sound collecting parts.

Also, there is a risk that a standing wave would be generated due to the sound wave being repeatedly reflected between the case and the microphone capsule. As a result, sound with a sense of presence cannot be properly collected.

SUMMARY

This invention focuses on these points, and an object of the invention is to provide a microphone device in which a sound wave properly enters the sound collecting parts of the spherical microphone capsule.

A case for a microphone device of the present invention includes a housing part that has a circuit board therein; and a protrusion part that protrudes from a first end face of the housing part in a longitudinal direction so as to expose to the outside, the protrusion part being formed such that a diameter of the protrusion part becomes smaller from a root coupled to the first end face toward a tip.

DESCRIPTION OF EMBODIMENTS

Hereinafter, the present invention will be described through exemplary embodiments of the present invention, but the following exemplary embodiments do not limit the invention according to the claims, and not all of the combinations of features described in the exemplary embodiments are necessarily essential to the solution means of the invention.

First Embodiment (Configuration of a Microphone Device)

A configuration of a microphone device according to the first embodiment of the present invention will be described by referring to FIGS. 1 to 8.

Figure 1:
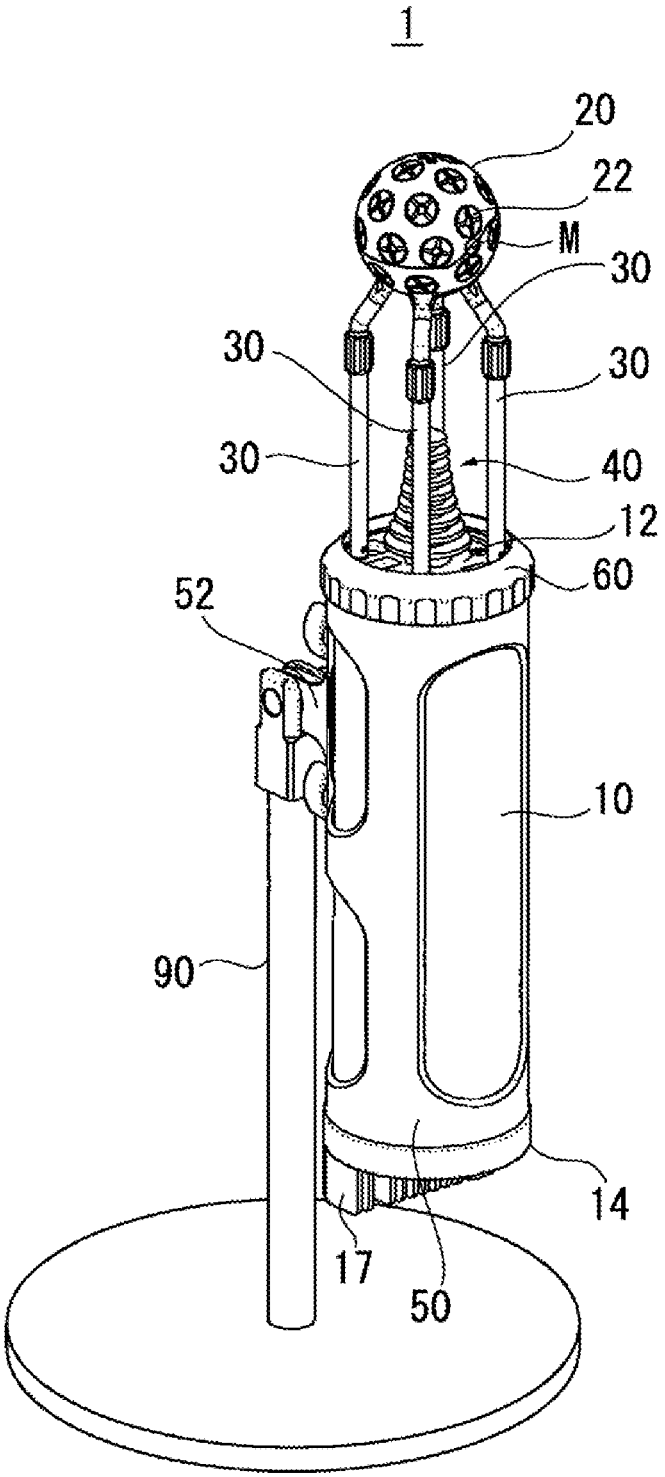
FIG. 1 is a perspective view showing an example of a microphone device 1 according to the first embodiment of the present invention in a state of use.
Figure 2:
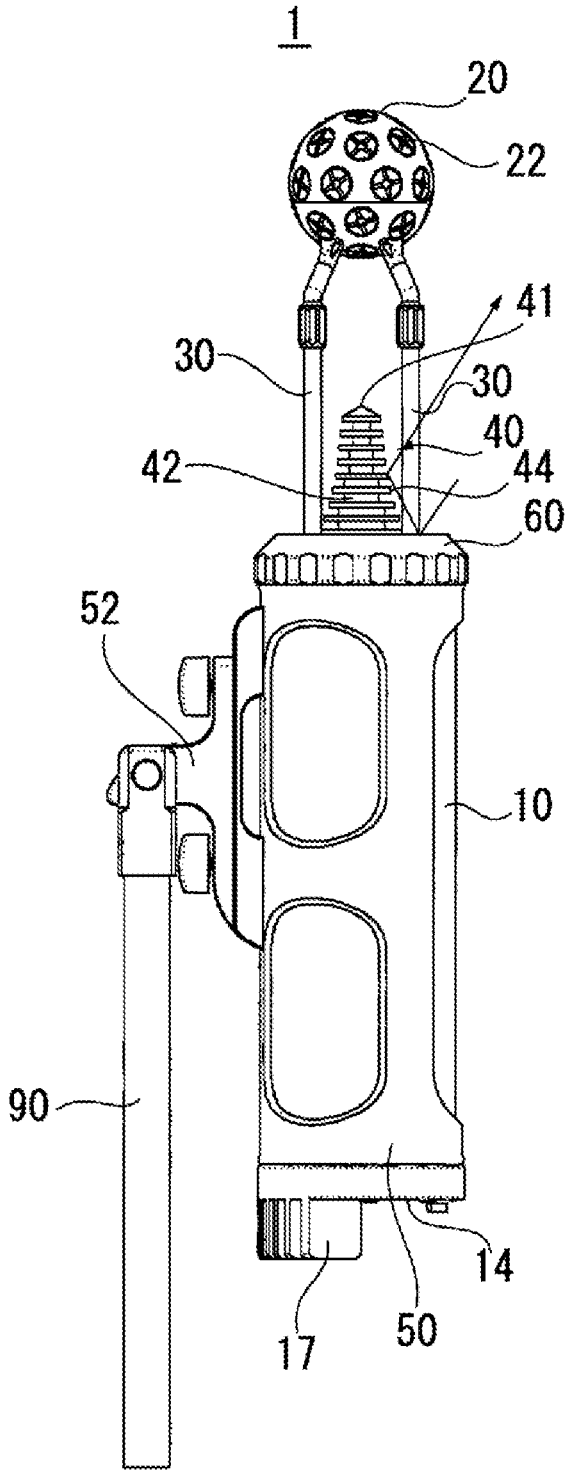
FIG. 2 is a view of the microphone device 1 viewed from the front.
Figure 3:
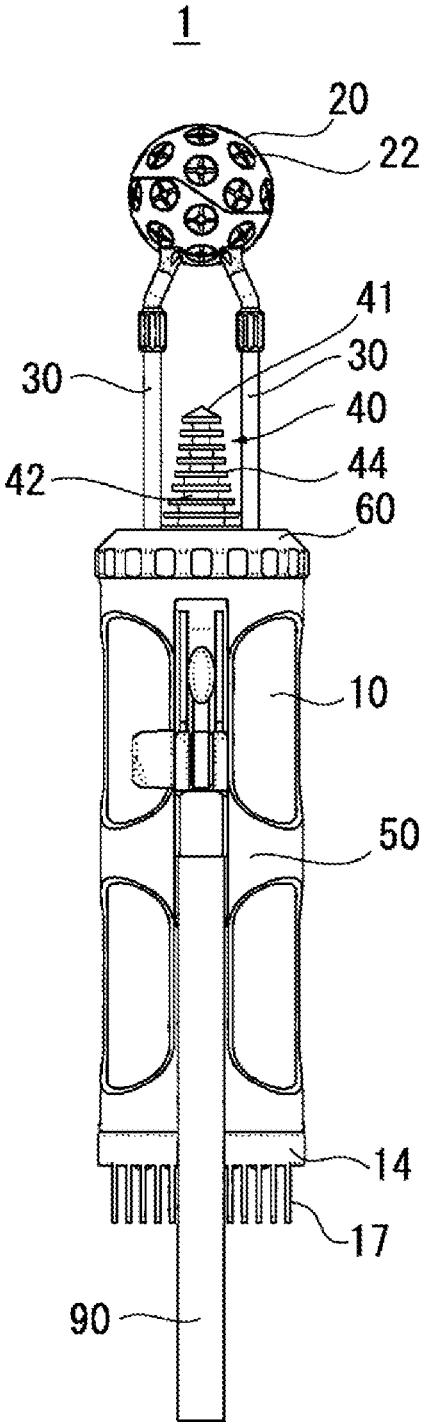
FIG. 3 is view of the microphone device 1 viewed from the left side.
Figure 4:
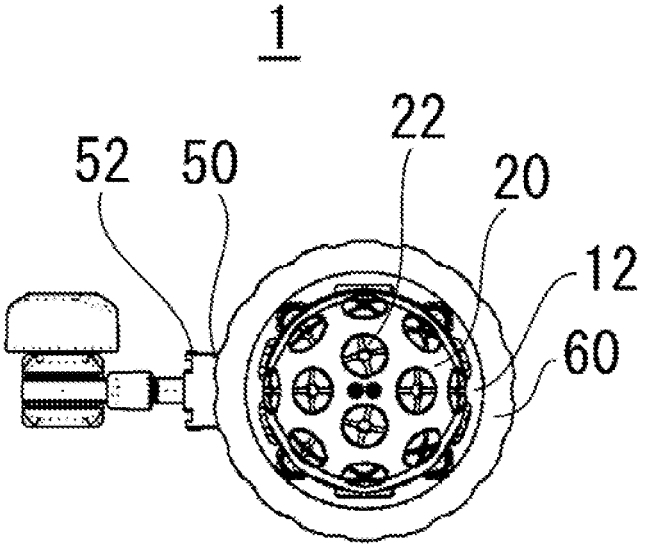
FIG. 4 is a view of the microphone device 1 viewed from the top.
Figure 5:
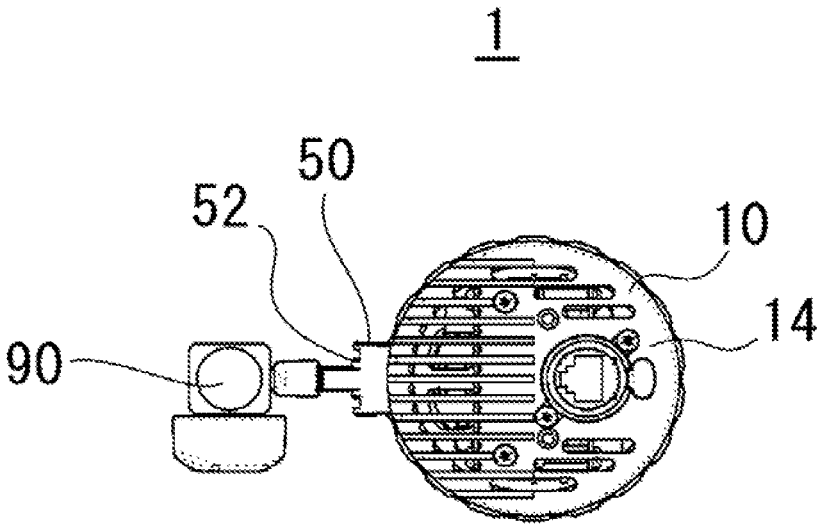
FIG. 5 is a view of the microphone device 1 viewed from the bottom.
Figure 6:
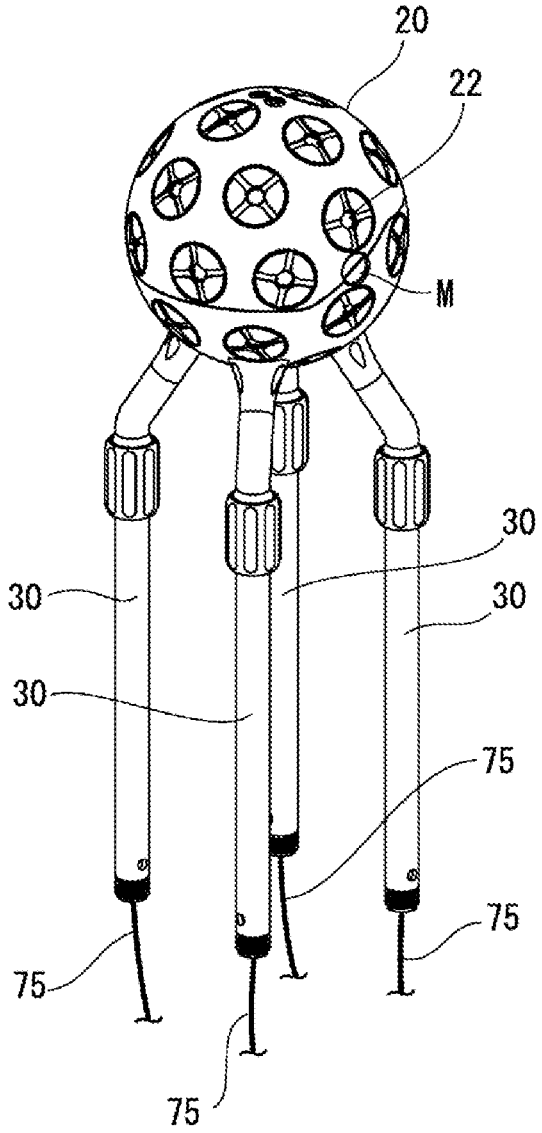
FIG. 6 illustrates a wiring of signal lines.
Figure 7:
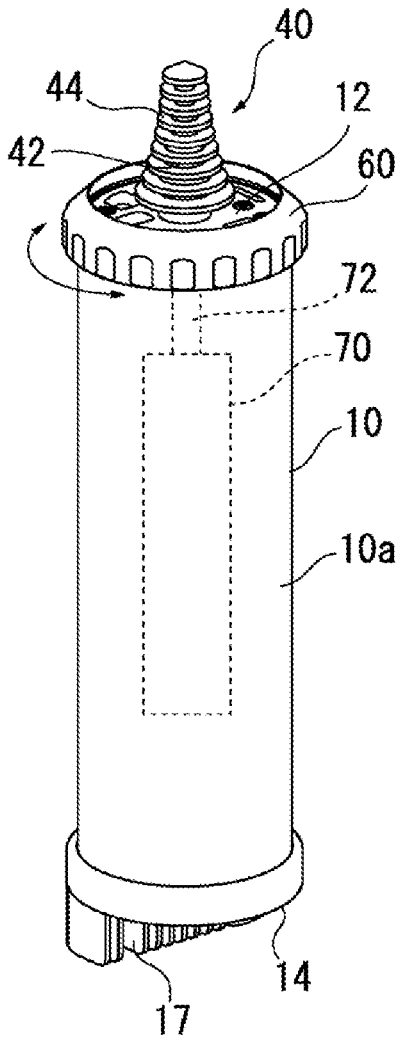
FIG. 7 illustrates a configuration of a case 10.
Figure 8:
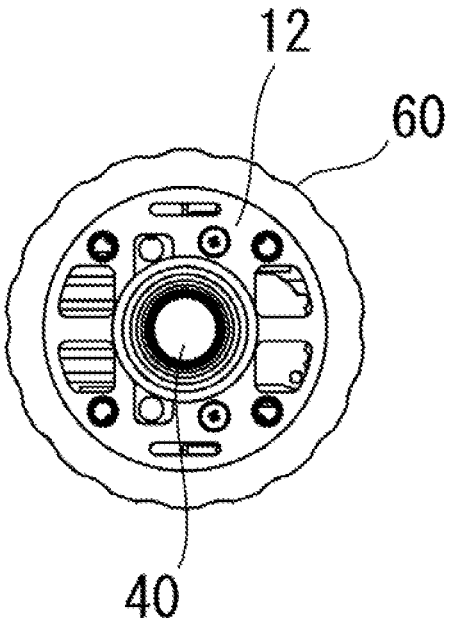
FIG. 8 illustrates a configuration of an end face of the first end of the case 10 in a longitudinal direction.

FIG. 1 is a perspective view showing an example of a microphone device 1 according to the first embodiment in a state of use. FIG. 2 is a view of the microphone device 1 viewed from the front. FIG. 3 is view of the microphone device 1 viewed from the left side. FIG. 4 is a view of the microphone device 1 viewed from the top. FIG. 5 is a view of the microphone device 1 viewed from the bottom. FIG. 6 illustrates a wiring of signal lines. FIG. 7 illustrates a configuration of a case 10. FIG. 8 illustrates a configuration of an end face of the first end of the case 10 in a longitudinal direction. It should be noted that in FIGS. 2 to 5, as a matter of convenience, a platform of a stand 90 shown in FIG. 1 is omitted.

The microphone device 1 is a so-called "Ambisonics microphone device" and is configured to collect sound from all 360-degree directions. For this reason, the microphone device 1 can collect sound with a sense of presence. The microphone device 1 is installed in various modes and used. For example, the microphone device 1 collects sound from all 360-degree directions, in a state fixed via the stand 90, as shown in FIG. 1, or in a state fixed to a ceiling. The microphone device 1 includes, as shown in FIG. 1 and the like, the case 10, a microphone capsule 20, pillars 30, a protrusion part 40, a holder 50, and a locking member 60.

The case 10 has, as shown in FIG. 7, a housing part 10*a* formed in a cylindrical shape. In an inside of the housing part 10*a*, a circuit board 70 (shown in FIG. 7) which performs signal processing of an electrical signal from the microphone capsule 20, wireless communication, and the like is provided. The circuit board 70 includes a digital conversion circuit and a network audio output circuit, and its number of outputs is more than that of conventional microphones. For that reason, a complicated calculation process is required which leads to an upsizing of the circuit board 70 and an increase in power density. Therefore, the amount of heat generated from the circuit board 70 increases.

The microphone capsule 20 includes a plurality of sound collecting parts 22, as shown in FIG. 6. The microphone capsule 20 is, as an example, formed in a spherical shape, and the plurality of sound collecting parts 22 are arranged at predetermined intervals on a spherical surface. Here, 32 units of the sound collecting parts 22 are disposed on the positions that are defined on the principle of a so-called higher order Ambisonics microphone. 32 units of the sound collecting parts 22 output electrical signals upon receiving sound waves respectively entering from predetermined directions. The electrical signals output from the 32 units of the sound collecting parts 22 are sent to the circuit board 70 in the case 10 via a signal line 75 (shown in FIG. 6) for 32-channel, and signal processing is performed by the circuit board 70. The circuit board 70 includes a wireless communication part that transmits audio data collected by each of the plurality of sound collecting parts 22 to the outside in accordance with communication standards and protocols such as the Internet protocol. Specifically, the circuit board 70 converts analog audio signals for 32-channel from 32 units of the sound collecting parts 22 into digital signals and into signal data, such as a packet, which is in accordance with the Internet protocol. Since the amount of processing increases in this manner, the circuit board 70 is upsized, and the amount of heat generated from the circuit board 70 also increases.

The microphone capsule 20 is downsized by narrowing intervals between the sound collecting parts 22, as shown in FIG. 6. A diameter of the microphone capsule 20, which is a sphere, is 50 (mm), for example, and is less than a diameter of the case 10, which is cylindrical. Typically, in the Ambisonics microphone, it is known that the larger a radius of the sphere, the narrower an effective frequency range becomes due to an occurrence of spatial aliasing in a low frequency when signal processing is performed. On the other hand, by downsizing the spherical microphone capsule 20 as in the present embodiment, it is possible to suppress the occurrence of spatial aliasing up to a higher frequency, and therefore expanding of the effective frequency range becomes possible. Consequently, it is possible to achieve higher performance of the microphone device 1 as the Ambisonics microphone.

The microphone capsule 20 is disposed in a state being separated from the case 10, as shown in FIG. 2, so that sound waves can enter each of the sound collecting parts 22 from all 360-degree directions. A distance between the microphone capsule 20 and the case 10 is greater than the diameter of the microphone capsule 20, for example. Also, the microphone capsule 20 has a mark part M (see FIGS. 1 and 6) that indicates the front of the microphone device 1.

The pillars 30 are provided in plurality as shown in FIG. 1 and support the microphone capsule 20. The plurality of pillars 30 each couple the first end face 12 of the first end of the housing part 10*a* in the longitudinal direction of the case 10 and the microphone capsule 20. That is, the first end of each of the pillars 30 in the longitudinal direction is fixed to the first end face 12 of the case 10, and the second end of each of the pillars 30 in the longitudinal direction is fixed to a portion between the sound collecting parts 22 which are adjacent to each other on the spherical surface of the microphone capsule 20. It should be noted that the first end face 12 of the case 10 corresponds to an opposed face that faces the microphone capsule 20.

Four pillars 30 are provided around a protrusion part 40 with 90-degree intervals in a circumference direction, as shown in FIG. 1. By disposing the pillars 30 at uniform intervals in this manner, the microphone capsule 20 can be stably supported. It should be noted that the number of pillars 30 to be provided was four in the above description, but the number of pillars 30 is not limited to this. For example, the number of pillars 30 may be two or five or more. However, it is optimal to provide four pillars 30 in the configuration in which 32 units of the sound collecting parts 22 are closely disposed on the surface of the sphere.

The plurality of pillars 30 are made slender in order to restrict them from becoming obstacles on a transmitting route of the sound wave. For example, as shown in FIG. 2, each diameter of the plurality of pillars 30 is less than that of the protrusion part 40. Also, making the diameter of the pillars 30 smaller makes it easier to fix the pillars 30 to the downsized microphone capsule 20.

The pillars 30 each have a cavity inside. In the cavity of each of the pillars 30, the signal line 75 (see FIG. 6) that connects the circuit board 70 in the case 10 and the sound collecting parts 22 is inserted (wired). For example, as shown in FIG. 6, many signal lines 75 for 32 channels corresponding to 32 units of the sound collecting parts 22 are divided into four and the divided four signal lines 75 are inserted respectively in each of the pillars 30. By inserting the signal lines 75 for 32 channels after dividing them into four in this manner, the signal lines 75 for 32 channels can be properly inserted even if the diameter of each of the pillars 30 is small. It should be noted that one signal line 75 is indicated for each of the pillars 30 in FIG. 6, but in fact, more than one of the signal lines 75 are inserted.

The protrusion part 40, as shown in FIG. 1, is a portion that protrudes from the case 10 toward the microphone capsule 20. Specifically, the protrusion part 40 is placed between the pillars 30 and protrudes from the first end face 12 of the case 10 toward the microphone capsule 20. The protrusion part 40 is formed so that its diameter becomes smaller from a root which is coupled to the first end face 12 toward a tip (that is, the protrusion part 40 has a tapered shape).

Here, the protrusion part 40, as shown in FIG. 7, is formed with a conical shape at the center of the first end face 12 of the housing part 10*a* in the longitudinal direction. Because the protrusion part 40 is formed with the above-mentioned shape, the protrusion part 40 diffuses arriving sound waves. For example, as indicated by an arrow in FIG. 2, the protrusion part 40 diffuses sound waves that reach the protrusion part 40 after reflecting off the first end face 12 to a direction different from a direction toward the microphone capsule 20. Also, because the protrusion part 40 is formed to protrude from the first end face 12, a flat area on the first end face 12 is relatively small. Accordingly, reflection of sound waves on the first end face 12 is suppressed. As a result, a phenomenon of the sound wave reflected off the first end face 12 entering the sound collecting parts 22 of the microphone capsule 20 is less likely to occur. Also, by having the protrusion part 40 diffuse the sound wave, a phenomenon of a standing wave being generated due to the sound wave being repeatedly reflected between the case 10 (for example, the first end face 12) and the microphone capsule 20 is less likely to occur. Furthermore, by providing the protrusion part 40, a phenomenon of a sound wave diffracted the case 10 reaching the sound collecting parts 22 is less likely to occur.

It should be noted that the protrusion part 40 is formed with the conical shape in the above description, but the shape is not limited to this. For example, the protrusion part 40 may be formed with a dome shape (hemispherical shape) or with a pyramid shape. With any of these shapes, it is possible to diffuse the sound waves that reach the protrusion part 40 to a direction different from the direction toward the microphone capsule 20. Also, it is possible to suppress the generation of the standing wave.

A tip portion 41 of the protrusion part 40 is formed such that an angle of taper is steeper at the tip portion 41 compared to a portion of the first end face 12 side of the protrusion part 40. Also, the tip portion 41 of the protrusion part 40 does not contact the microphone capsule 20, as shown in FIG. 2. Here, a protrusion height from the first end face 12 of the protrusion part 40 is equal to or less than one half of a distance between the first end face 12 and the microphone capsule 20. This configuration prevents negative effects that would occur on the sound collecting parts 22 due to the tip portion 41 of the protrusion part 40 being too close to the microphone capsule 20.

As shown in FIG. 7, the protrusion part 40 is connected to the circuit board 70 in the case 10 via a metal member 72 in a manner to realize thermal conductivity, and releases heat generated by the circuit board 70 to outside. That is, the protrusion part 40 includes a function of serving as a heat sink of the circuit board 70. As mentioned above, the circuit board 70 becomes larger and its power density increases according to calculation processing because the circuit board 70 includes a digital conversion circuit and a network audio output circuit. This results in an increase of the amount of heat generated by the circuit board 70. Therefore, since the protrusion part 40 has the function of the heat sink, it is possible to increase the cooling efficiency of the circuit board 70. It should be noted that due to the nature of equipment that collects sound, the microphone device 1 cannot have a cooling fan. The microphone device 1 can realize a quiet heat dissipation mechanism because the protrusion part 40 includes the function of the heat sink.

The protrusion part 40 includes a shaft part 42 and fins 44, as shown in FIG. 2. The shaft part 42 extends straight (in an axial direction) from the first end face 12 toward the microphone capsule 20. That is, the shaft part 42 extends from the root coupled to the first end face 12 of the protrusion part 40 toward the tip. A diameter of the shaft part 42 becomes smaller from the root to tip of the protrusion part 40.

The fins 44 are protruding from an outer peripheral surface of the shaft part 42 and are arranged at predetermined intervals along the axial direction. The fins 44 are each protruding from the outer peripheral surface of the shaft part 42 in a normal direction. Also, as shown in FIG. 7, each of the fins 44 is formed with a disc shape of a predetermined thickness, and the diameters of the fins 44 each become smaller toward the tip of the protrusion part 40. An outer surface of each of the disc-shape fins 44 forms a part of a side surface of the conical protrusion part 40. By having the plurality of fins 44 in such a form, the surface area of the protrusion part 40 increases, and therefore the heat dissipation effect of the protrusion part 40 is enhanced.

A holder 50, as shown in FIG. 1, is a holding member that holds the case 10. The holder 50 is formed with a thin-walled cylindrical shape and provided such that the holder 50 covers an outer peripheral surface of the case 10. The holder 50 holds the case 10 in such a manner that both the case 10 and the microphone capsule 20 can rotate in the circumference direction. Also, the holder 50, as shown in FIG. 2, includes a fixing part 52 to be fixed to the stand 90.

When rotated in one direction in the circumference direction (a direction shown by an arrow in FIG. 7), the locking member 60 brings the holder 50 and the case 10 into a locked state. When rotated in an opposite direction of the aforementioned one direction in the circumference direction, the locking member 60 releases the locked state. When the locked state of the case 10 with respect to the holder 50 is released, a user can adjust a position of the microphone capsule 20 by rotating the case 10 in the circumference direction with respect to the holder 50 in the state of being fixed to the ceiling. By this, even after the holder 50 is fixed to the ceiling, the user can adjust the microphone capsule 20, for example, to have an orientation with which sound can be more easily collected (or to have an orientation with which the sound waves can be diffused more easily by the protrusion part 40) by releasing the locked state with the locking member 60 which is a position adjusting member.

It should be noted that, on the second end of the case 10 in the longitudinal direction, fins 17 are provided such that the fins 17 protrude from the second end face 14. In a similar manner as with the fins 44 of the protrusion part 40, the fins 17 also have a function of dissipating heat. For example, the fins 17 are connected to the circuit board 70 in the case 10 via a metal member (not shown) and may dissipate heat of the circuit board 70.

(Effect of First Embodiment)

In the microphone device 1 of the above-described first embodiment, the protrusion part 40 that protrudes from the first end face 12 of the case 10 toward the microphone capsule 20 is provided between the pillars 30 supporting the microphone capsule 20 apart from the case 10. The protrusion part 40 is formed such that its diameter becomes smaller from the root which is coupled to the first end face 12 toward the tip.

According to the above-mentioned configuration, the protrusion part 40 diffuses the sound waves that reach the protrusion part 40 after reflecting off the first end face 12 to a direction different from the direction toward the microphone capsule 20. Also, because the protrusion part 40 is formed to protrude from the first end face 12, the flat area on the first end face 12 is small Thus, the reflection of sound waves off the first end face 12 is suppressed. As a result, the phenomenon of the sound wave reflected off the first end face 12 entering the sound collecting parts 22 of the microphone capsule 20 is less likely to occur. Also, by having the protrusion part 40 diffuse the sound wave, the phenomenon of the standing wave being generated due to the sound wave being repeatedly reflected between the case 10 and the microphone capsule 20 is less likely to occur. Consequently, the microphone device 1 efficiently functions as the Ambisonics microphone because the sound collecting parts 22 can properly collect sound from all 360-degree directions.

Second Embodiment

A configuration of a microphone device according to the second embodiment of the present invention will be described by referring to FIGS. 9 and 10.

Figure 9:
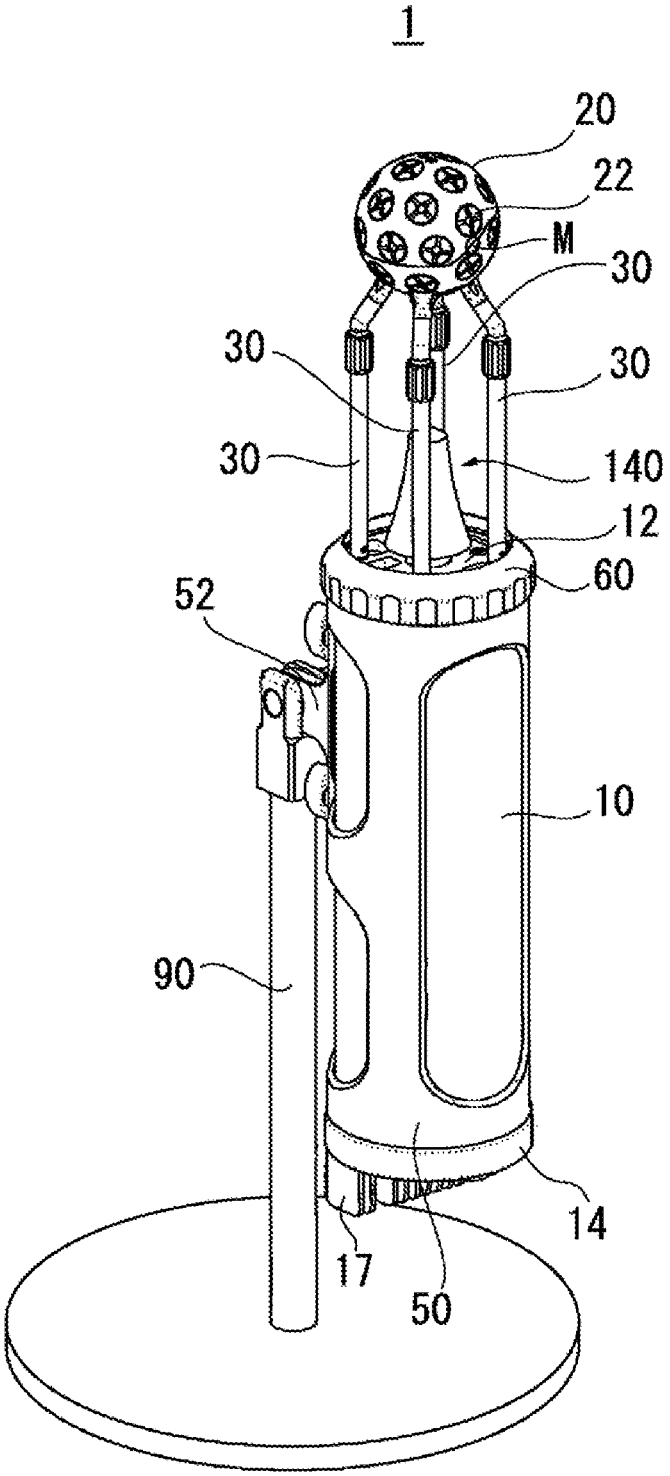
FIG. 9 is a perspective view showing an example of a microphone device 1 according to the second embodiment of the present invention in a state of use.

FIG. 9 is a perspective view showing an example of the microphone device 1 according to the second embodiment in a state of use. FIG. 10 is a view of the microphone device 1 viewed from the front. In the second embodiment, the configuration of a protrusion part 140 of the microphone device 1 differs from that of the protrusion part 40 of the first embodiment, and the other configurations of the microphone device 1 of the second embodiment are the same as those of the first embodiment. For this reason, the description of the configurations of the microphone device 1 of the second embodiment other than the protrusion part 140 will be omitted.

Figure 10:
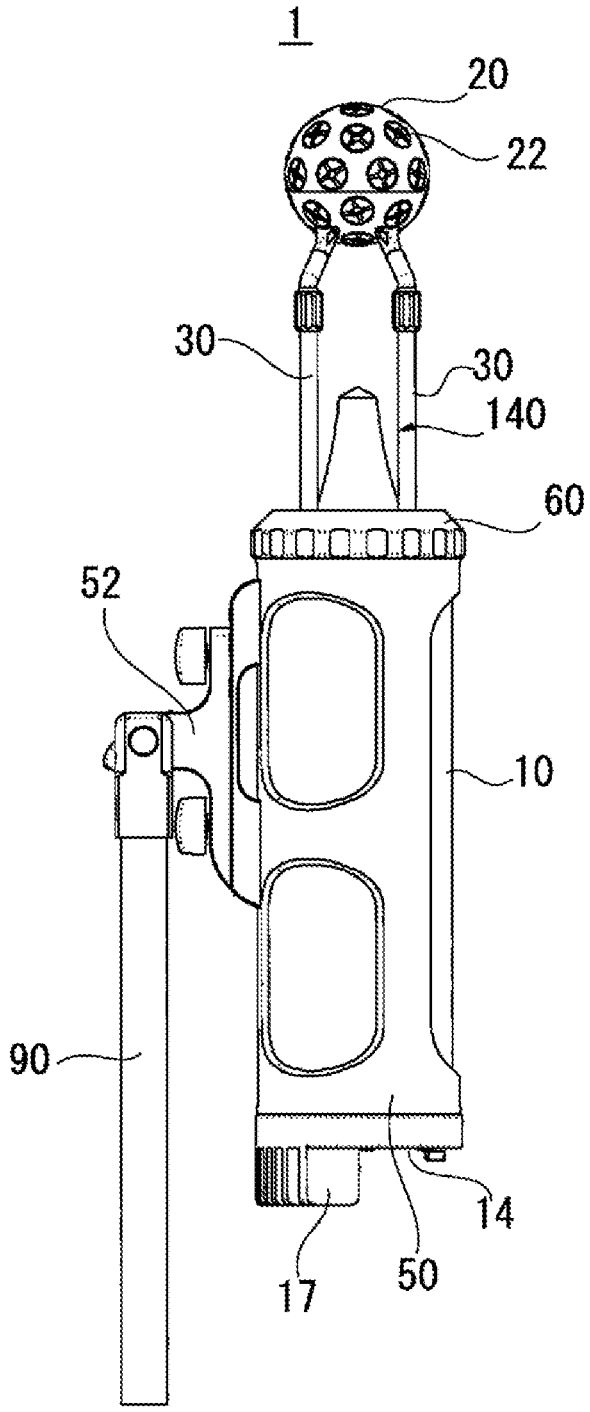
FIG. 10 is a view of the microphone device 1 viewed from the front.

As shown in FIGS. 9 and 10, the protrusion part 140 of the second embodiment is formed so that its diameter becomes smaller from the root which is coupled to the first end face 12 toward the tip (in a tapered shape). Meanwhile, in the second embodiment, the fins 44 for dissipating heat (see FIG. 2) described in the first embodiment are not provided on the protrusion part 140, and the protrusion part 140 takes the shape of a cone. For this reason, the shape of the protrusion part 140 is simplified, and therefore the protrusion part 140 is easily formed. It should be noted that, in the second embodiment, heat may be dissipated by using the fins 17 arranged on the second end face 14 side of the case 10. Also, the shape of the protrusion part 140 is not limited to the shape of a cone, and it may be, for example, in a dome shape or in a pyramid shape.

The protrusion part 140 is formed such that its diameter becomes smaller from the root which is coupled to the first end face 12 toward the tip in the second embodiment as well. For this reason, the protrusion part 140 diffuses the sound waves that reach the protrusion part 140 after reflecting off the first end face 12 to a direction different from the direction toward the microphone capsule 20. Also, because the protrusion part 140 is formed to protrude from the first end face 12, the flat area on the first end face 12 becomes small. Thus, the reflection of sound waves on the first end face 12 is suppressed.

The present invention is explained on the basis of the exemplary embodiments. The technical scope of the present invention is not limited to the scope explained in the above embodiments and it is possible to make various changes and modifications within the scope of the invention. For example, the specific embodiments of the distribution and integration of the apparatus are not limited to the above embodiments, all or part thereof, can be configured with any unit which is functionally or physically dispersed or integrated. Further, new exemplary embodiments generated by arbitrary combinations of them are included in the exemplary embodiments of the present invention. Further, effects of the new exemplary embodiments brought by the combinations also have the effects of the original exemplary embodiments.

What is claimed is:

1. A case for a microphone device, comprising:
a housing part that has a circuit board therein; and
a protrusion part that protrudes from a first end face of the housing part in a longitudinal direction so as to expose to the outside, the protrusion part being formed such that a diameter of the protrusion part becomes smaller from a root coupled to the first end face toward a tip,
wherein a plurality of fixing parts to which a plurality of pillars that support a microphone capsule are respectively fixed are provided around the protrusion part in the first end face.

2. The case for the microphone device according to claim 1, wherein the protrusion part is connected in a manner to be thermally conductive to the circuit board via a metal member.

3. The case for the microphone device according to claim 1, wherein the first end face in the longitudinal direction is a top surface of the housing part.

4. The case for the microphone device according to claim 1, wherein an angle of taper of a tip portion of the protrusion part is steeper than the angle of taper of a portion on the first end face side.

5. The case for the microphone device according to claim 1, further comprising a plurality of fins that are provided on a second end face of the case in the longitudinal direction such that the fins protrude to the outside.

6. The case for the microphone device according to claim 1, wherein the protrusion part is formed with a conical shape at a center of the first end face of the housing part.

7. The case for the microphone device according to claim 1, wherein the microphone device is an Ambisonics microphone device that collects sound from all directions.

* * * * *